US006076525A

United States Patent [19]

Hoffman

[11] Patent Number: 6,076,525

[45] Date of Patent: Jun. 20, 2000

[54] FRAME FOR PRONE SURGICAL POSITIONING

[76] Inventor: Michael D. Hoffman, 325 Lakeshore Dr., McCook Lake, S. Dak. 57049-4002

[21] Appl. No.: 09/238,149

[22] Filed: Jan. 28, 1999

[51] Int. Cl.[7] ..... A61G 15/00

[52] U.S. Cl. ..... 128/845; 128/846; 269/323

[58] Field of Search ..... 128/845, 846, 128/869, 870; 5/607, 613, 621, 632; 269/323

[56] References Cited

U.S. PATENT DOCUMENTS

| | | |
|---|---|---|
| 516,587 | 3/1894 | Campbell . |
| 4,579,111 | 4/1986 | Ledesma . |
| 4,662,619 | 5/1987 | Ray et al. . |
| 5,009,407 | 4/1991 | Watanabe . |
| 5,014,375 | 5/1991 | Coonrad et al. . |
| 5,088,706 | 2/1992 | Jackson . |
| 5,131,106 | 7/1992 | Jackson . |
| 5,444,882 | 8/1995 | Andrews et al. . |
| 5,584,302 | 12/1996 | Sillaway et al. . |

FOREIGN PATENT DOCUMENTS

| | | |
|---|---|---|
| 882476 | 10/1952 | Germany . |

OTHER PUBLICATIONS

Relton, et al., Journal of Bone and Joint Surgery [Br], vol. 49B, No. 2, 1967, pp. 327–332.

Callahan, et al., Clinical Orthopaedics and Related Research, No. 154, Jan.–Feb. 1981, pp. 22–26, 1981.

Kumar, et al., Journal of Pediatric Orthopaedics, vol. 14, 1994, pp. 383–384.

Tan, et al., Spine, vol. 19, No. 3, 1994, pp. 314–318.

M. Meeker, Alexander's Care of the Patient in Surgery, 1995, pp. 106–107.

Peterson, et al., Spine, vol. 20, No. 12, 1995, pp. 1419–1424.

Guanciale, et al., Spine, vol. 21, No. 8, 1996, pp. 964–969.

Stephens, et al., Spine, vol. 21, No. 15, 1996, pp. 1802–1807.

*Primary Examiner*—Michael A. Brown

*Attorney, Agent, or Firm*—Richard C. Litmar

[57] ABSTRACT

The frame for prone surgical positioning is a frame placed on a conventional operating table and used to position a patient in a prone position for surgery on the spine. The frame has an open, rectangular base defined by two longitudinal beams and two lateral beams, the size of the base being adjustable by sliding the beams though metal sleeves and clamping the beams in the desired relation by thumbscrews. The base supports six vertical posts, two of the posts being mounted on sleeves at one end of the longitudinal beams and between the longitudinal beams, the remaining four posts being mounted on the longitudinal beams. Resilient patient positioning pads are mounted on top of the vertical posts. The position of the vertical posts on the base may be adjusted, the vertical posts being mounted to the beams by metal sleeves clamped to the beams by thumbscrews. One pair of the pads are positioned under the patient's body to support the patient's upper chest, a second pair to support the antero-lateral aspects of the thorax, and the third pair to support the pelvis. The base may be mounted on non-skid feet.

12 Claims, 4 Drawing Sheets

FRAME FOR PRONE SURGICAL POSITIONING

BACKGROUND OF THE INVENTION

1. Field of the Invention

The present invention relates to surgical appliances, and particularly to a frame placed on a conventional surgical operating table which positions the patient in a prone position for spinal surgery, and is especially suited for positioning the patient for a lumbar laminectomy with spinal fusion.

2. Description of the Related Art

Surgery on the spine is usually performed in either the lateral recumbent or the prone position. The lateral recumbent position is usually used for procedures where both an anterior and posterior approach are used. However, the position does not permit a wide view of the intervertebral disks and it is difficult to control bleeding. Therefore, a prone position is normally used for a posterior approach.

Originally the prone position simply involved having the patient in a recumbent position with his abdomen on the surface of the operating treatment. However, in this position there was copious bleeding due to pressure on the inferior vena cava. It was found that there was less bleeding if the patient were elevated so that the abdomen was distended and might hang freely. The simplest method for accomplishing this is to position chest rolls or bolsters on the table under the axillae and along the sides of the chest from clavicles to iliac crests. However, this has not been found to be completely satisfactory, and a number of devices for positioning the patient in a prone position with the abdomen distended have been developed. A number of devices may be distinguished by the degree to which the hips and knees are flexed.

German Patent No. 882,476, published Oct. 23, 1952, shows an adaptor for a surgical table having a T-connector for supporting the hips which attaches to leg support brackets of a conventional surgical table. A system of bars describing a U-shape is attached to the bottom of the T-connector. The other upright of the U-shape has supports under the axillae, a support for the upper chest, a head support and arm supports. While the abdomen is distended, the T-connector may produce enough pressure across the pelvis to impair venous return, and the use of shoulder supports directly under the axillae is questionable due to the possibility of impaired blood flow and damage to the brachial plexus. The device is not currently used.

The Relton-Hall frame is described in *J. Bone Joint Surg.* [Br], 49(2), 327 (1967). An example of positioning the patient on a Relton-Hall frame is shown in "Positioning Techniques in Spinal Surgery", R. A. Callahan and M. D. Brown, *Clinical Orthopaedics and Related Research*, Jan.–Feb. 1981, No. 154, pp. 22–26. The Relton-Hall frame is a frame which is placed on top of a conventional operating table, the frame having a generally rectangular base frame, four vertical posts clamped onto the frame and adjustable longitudinally and laterally, and pads having a 45° inward tilt at the top of the vertical posts. The pads are positioned under the antero-lateral aspects of the pelvic girdle and under the lateral aspects of the upper thoracic cage as close to the midline as possible. The hips may be flexed up to 60°. One problem with the Relton-Hall frame is that intraoperative x-rays are rendered difficult by the metal frame.

A modification to the Relton-Hall frame to overcome this problem is shown in "A Radiolucent Spine Frame: A Modification of the Relton-Hall Spine Frame", Kumar, et al., *Journal of Pediatric Orthopaedics*, 14:383 (1994). The modification describes a base composed of two sheet layers having a space between the two layers for containing an x-ray cassette. The base measures 35"×18", the bottom layer comprising high density polyethylene glued to soft Aliplast, the top layer comprising Plexiglass covered by Velcro®. Four vertical support posts are attached to the base by Velcro® strips, the top of the posts being tilted at a 45° angle and capped with pads of vinyl-covered temper foam.

A Hastings frame is described in "A Simple Frame for Operations on the Lumbar Spine", D. E. Hastings, *The Canadian Journal of Surgery*, 12:251 (1969). The frame includes a pair of parallel horizontal beams, a pair of parallel vertical posts mounted at right angles to the beams, a pair of diagonal struts between the beams and posts, a seat mounted between the vertical posts, an adjustable cross beam placed between the struts about the patients feet, and a pair of metal straps on the vertical posts for mounting the frame to the operating table. The patient is placed on the table in the knee-chest position with the buttocks against the seat, the feet against the cross beam, the chest supported on a box between four and eighteen inches high, depending on whether a spinal fusion is being performed, and the table is tilted in a reverse Trendlenberg to position the spine horizontally in a prone position. The hips are hyperflexed somewhat more than 90°, flexing the lumbar spine to spread the vertebrae and provide open access to the disks, while also reducing hemorrhage.

An improved kneeling attachment for an Andrews frame is described in U.S. Pat. No. 4,662,619, issued May 5, 1987 to Ray, et al. The Andrews frame includes a rigid thigh support pivotally attached to an operating table, the thigh supports having a rail on either side, rigid lower leg supports slidingly and lockably engaging the rails, and a rack and pinion drive for sliding the lower leg platform up and down on the rails, the Ray patent describing improvements in the kneeling attachment. The Andrews frame has since been improved to a table, as described in U.S. Pat. No. 5,444,882, issued Aug. 29, 1995 to Andrews, et al. The table includes a plurality of hydraulic cylinders for adjusting segments of the operating table and rotating the table. The patient lies flat on the table with the hips extended, the lower leg support is rotated to flex the knees at 90° vertically, the thigh supports are rotated to 60° to place the patient in a prone kneeling position, in which x-rays may be taken through a "radiolucent opening", and the thigh supports are rotated to the operative position, in which both the hips and knees are flexed at 90°.

The Wilson frame is shown as prior art in FIGS. 1 to 4 in U.S. Pat. No. 5,584,302, issued Dec. 17, 1996 to Sillaway, et al., and photographically in *Alexander's Care of the Patient in Surgery*, published by Mosby in 1995 at p. 107. The Wilson frame includes a pair of spaced apart panels on a base frame, the panels being flexible and the base being adjustable by a hand crank mechanism which arches the panels. The patient is supported by pads on the panels extending from about the axillae to the hips. With the patient lying prone on the flat frame, the surgeon may raise the panels using the crank to obtain the desired flexion of the spine.

The Jackson table is shown in U.S. Pat. Nos. 5,088,706, issued Feb. 18, 1992, and 5,131,106, issued Jul. 21, 1992, to R. P. Jackson. The Jackson table includes a U-shaped base in a horizontal plane with vertical end supports and a pair of hydraulic lifts. A pair of vertical posts rising from the end members is equipped with a rotating mechanism. An open, rectangular patient support frame having a fabric stretched across its lower end for support of the patients legs is removably mounted in the rotating mechanism. The table has two pairs of pads mounted on the sides of the rectangular patient support frame for support of the antero-lateral aspects of the pelvis and a pair of pads for support of the lateral aspects of the thoracic area. The frame is adjustable longitudinally, but only in conjunction with changing the angle of the bed, and the patient support frame is apparently not adjustable laterally, since the ends of the rectangular frame comprise rigid, U-shaped structures. The '106 patent added a strap about the hips to hold the patient prone and altered the pads, providing a pair of pads to support the chest, hips, and thighs, respectively, the chest pads being larger than the hip and thigh pads and being angled towards the patient's head, all of the pads being trapezoidal in shape and angled downwards towards the centerline. The Jackson table may support the patient with the hips flexed about 30°.

U.S. Pat. No. 5,009,407, issued Apr. 23, 1991 to R. S. Watanabe, shows a surgical table for microscopic lumbar laminectomy surgery having a horizontal base, vertical columns at each end of the base, one of the columns supporting a knee rest and the other supporting a cantilevered table top with shoulder rests and hip rests, the height of the columns being adjustable and the table top also being adjustable angularly around a pivot transverse through the vertical column. The table positions the patient with the hips and knees flexed 90°.

Other devices considered less relevant include: U.S. Pat. No. 516,587, issued Mar. 13, 1894 to A. H. Campbell (combination sofa, chair, and surgeon's table); U.S. Pat. No. 4,579,111, issued Apr. 1, 1986 to J. C. Ledesma (pad to prevent lumbar laminectomy patient from rolling during surgery); and U.S. Pat. No. 5,014,375, issued May 14, 1991 to Coonrad, et al. (resilient foam surgical pad with hole in the center to support the torso).

Each of the above frames and tables have their advantages and disadvantages, the choice of the device often being dictated by the particular surgical procedure. Frames which support the patient with the hips and knees flexed at least 90°, such as the Andrews table and Hastings frame, offer wide exposure of the lumbar disks and reduced bleeding. However, recent studies have indicated that when spinal fusion with instrumentation or surgical procedures involving internal fixation are concerned, it is important to maintain an intraoperative curvature of the spine close to the normal lordotic curve of the spine in the standing position, for which the Jackson table, four poster frames like the Relton-Hall, and other frames which support the patient with 60° or less flexion of the hips are better suited, although some studies show that the four poster frames are less effective in doing so than chest rolls. See Guanciale, et al., *Spine*, 21(8), 964 (1996), Peterson, et al., *Spine*, 20(12), 1419 (1995), Stephens, et al., *Spine*, 21(15), 1802 (1996), Tan, et al., *Spine*, 19(3), 314 (1994). In addition, for such procedures it is important to have the capacity for performing C-arm fluoroscopy or x-rays intraoperatively to ensure proper alignment. A third consideration is cost, surgical tables with hydraulic equipment designed particularly for prone position surgery being more expensive and less compact and portable than frames used in conjunction with standard operating tables.

None of the above inventions and patents, taken either singularly or in combination, is seen to describe the instant invention as claimed. Thus a prone surgical positioning frame solving the aforementioned problems is desired.

SUMMARY OF THE INVENTION

The frame for prone surgical positioning is a frame placed on a conventional operating table and used to position a patient in a prone position for surgery on the spine. The frame has an open, rectangular base defined by two longitudinal beams and two lateral beams, the size of the base being adjustable by sliding the beams though metal sleeves and clamping the beams in the desired relation by thumbscrews. The base supports six vertical posts, two of the posts being mounted on sleeves at one end of the longitudinal beams and between the longitudinal beams, the remaining four posts being mounted on the longitudinal beams. Resilient patient positioning pads are mounted on top of the vertical posts. The position of the vertical posts on the base may be adjusted, the vertical posts being mounted to the beams by metal sleeves clamped to the beams by thumbscrews. One pair of the pads are positioned under the patient's body to support the patient's chest, a second pair to support the antero-lateral aspects of the thorax, and the third pair to support the pelvis. The base may be mounted on non-skid feet.

The frame is designed to support the patient in a prone position with the hips flexed to less than 60°. Preferably, the hips and knees are flexed to about 30°. Advantageously, the vertical posts are shorter than the posts of the conventional Relton-Hall frame, permitting less flexion of the hips and a better fit between the arms of a C-arm fluoroscope. The use of six vertical posts instead of four provides more support for the thoracic and thoracolumbar spine, better preserving the normal lordotic curve of the spine, making the frame particularly useful for laminectomies at all levels of the spine, and particularly those procedure involving spinal fusion with instrumentation or internal fixation of the spine. Posteroanterior (PA) x-rays may be taken by placing the x-ray cassette on the table under the frame, or C-arm fluoroscopy may be used if the operating table is radiographic or has radiolucent segments in order to ensure proper positioning of the implants. Of course, lateral and oblique radiographs may also be taken.

The Jackson table is a high quality, sophisticated surgical table. However, in the frame of the present invention, unlike the Jackson table, the lateral width of the rectangular base may be adjusted. This feature allows the frame to be adjusted to better support children and those adults with a narrower skeletal frame than normal. The frame may also be disassembled for compact storage on a shelf, as opposed to a complete table, such as the Jackson table, which is typically about eleven feet long and requires two people to manoeuver. The frame of the present invention also has the advantage of being much more economical to manufacture.

Accordingly, it is a principal object of the invention to provide a frame for use with a conventional operating table for positioning a patient in a prone position in which the curve of the spine during surgery approaches the normal lordotic curve of the spine in the standing position in order to facilitate surgical procedures involving instrumentation or internal fixation of the spine.

It is another object of the invention to provide a frame for use with an operating table for positioning a patient in a prone position in which the abdomen is pendulous to reduce hemorrhage, but which permits intraoperative radiographs of the spine, or C-arm fluoroscopy of the spine with a radiolucent table.

It is a further object of the invention to provide a frame for use with an operating table for positioning a patient in a prone position in which the position of the patient support pads are adjustable longitudinally and laterally in order to accommodate the different skeletal sizes of children and adults.

Still another object of the invention is to provide a frame for use with an operating table for positioning a patient in a prone position which supports the patient at six locations and with a low profile for better positioning of the spine for internal fixation.

It is a yet another object of the invention to provide a frame for use with an operating table for positioning a patient in a prone position which may be disassembled for compact storage and transport.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
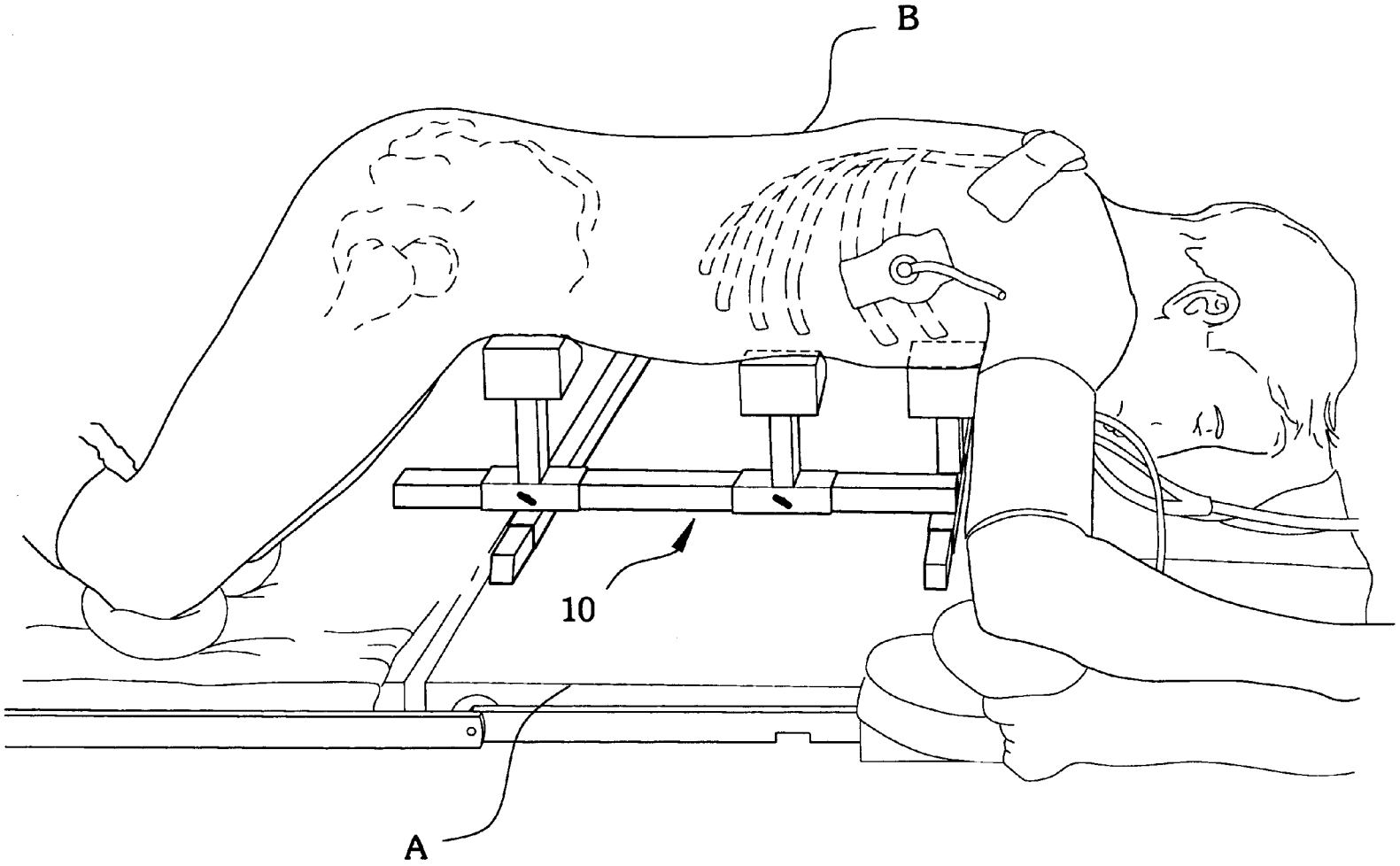
FIG. 1 is an environmental, perspective view of a frame for prone surgical positioning according to the present invention.

The present invention is a frame for prone surgical positioning, designated generally as 10 in the drawings. As shown in FIG. 1, the frame 10 is placed on an operating table A and the patient B is positioned on the frame 10 in the prone position, supported generally under the hips, the antero-lateral aspects of the chest, and the upper chest, as set forth more fully below. The operating table A may be a conventional operating table, or it may be a radiographic operating table with a radiolucent section below the patient's spine.

Figure 2:
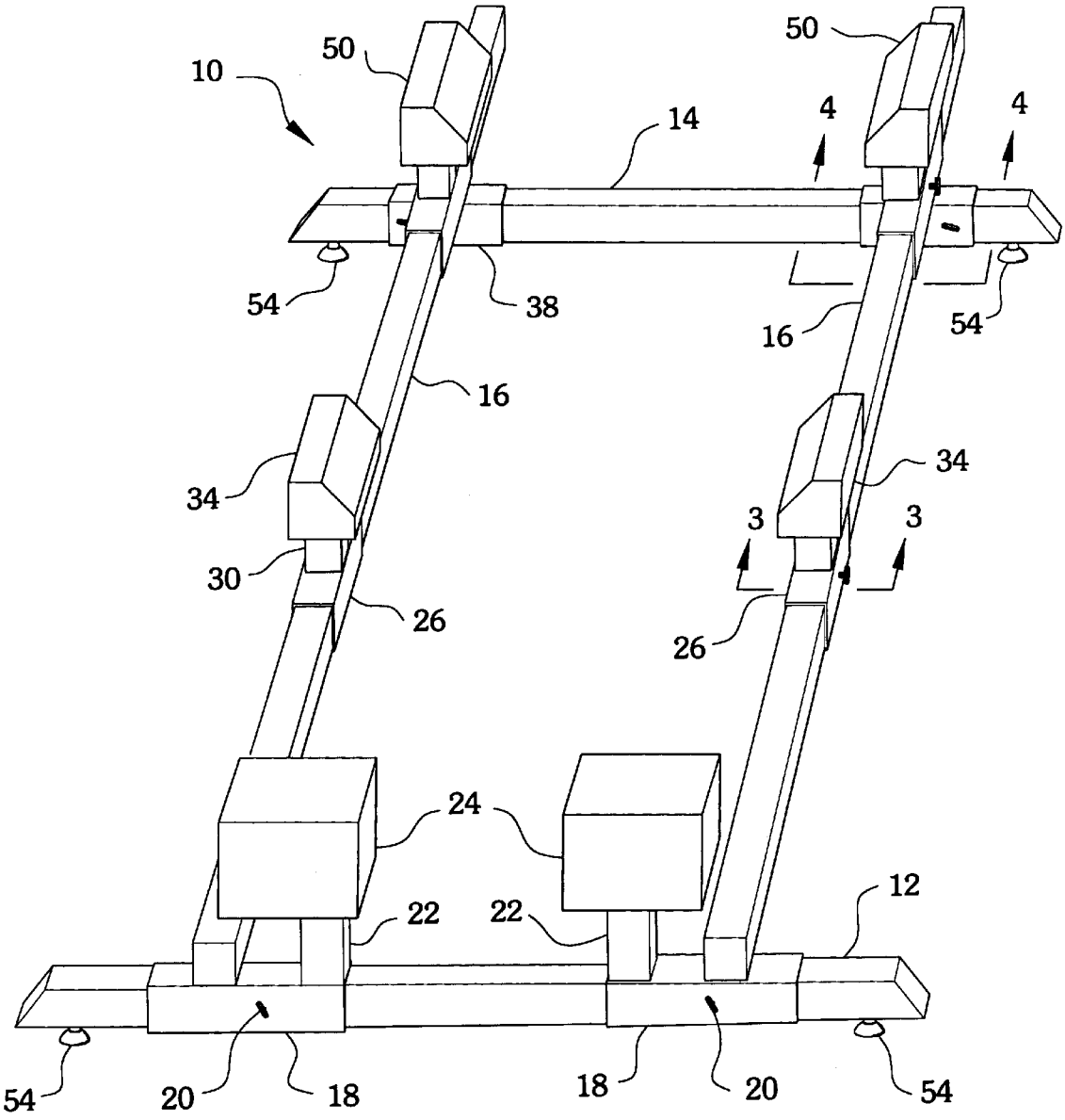
FIG. 2 is a perspective view of a frame for prone surgical positioning according to the present invention.

The frame 10 is shown more generally in FIG. 2. The frame has an open, rectangular shaped base defined by a first lateral beam 12, a second lateral beam 14, and a pair of longitudinal beams 16. The beams 12, 14, and 16, are preferably square in cross section and may be made from wood, aluminum, stainless steel, or other structural materials, as is conventionally known in the art. In the preferred embodiment, the beams 12, 14, and 16 are made from stainless steel and are hollow, tubular, and capped at the ends. Exemplary dimensions of the beams in the preferred embodiment may be a cross section measuring 1" by 1", lateral beams 12 and 14 measuring about twenty inches, and longitudinal beams 16 measuring about twenty-four inches. The base is positioned horizontally on the operating table A, the first lateral beam 12 being aligned towards the head of the table A.

A pair of hollow sleeves 18 which are square in cross section and which have an inside perimeter slightly larger than the outside perimeter of the first lateral beam 12 are slidably disposed about the beam 12 and temporarily secured to the beam 12 by thumbscrews 20. Each sleeve 18 has a vertical post 22 extending at right angles to the sleeve 18. The posts 22 preferably are constructed from the same material and have the same cross sectional shape and dimensions as the lateral beam 12. An exemplary length for the vertical posts 22 is about four inches. One end of the longitudinal beams 16 are preferably fixedly attached to the top surface of the sleeves 18, as by welding, in spaced apart relation from the vertical posts 22, each longitudinal beam being positioned towards the outside of the frame 10, so that the sleeve assemblies 18 are mirror images of each other.

Upper chest pads 24 are mounted on stainless steel platforms by hook and loop fastening material (described below in conjunction with the vertical posts shown in FIGS. 3 and 4) at the top end of the vertical posts 22. The upper chest pads 24 are preferably rectangular in vertical cross section and may be made from any conventionally known surgical pad material. An exemplary material which could be used is a viscoelastic, polymeric material sold under the trade name Akton® Polymer by Action Products, Inc. of Hagerstown, Md., product number 40616, but custom sized, preferably to 4"L×3"W×3"H.

Figure 3:
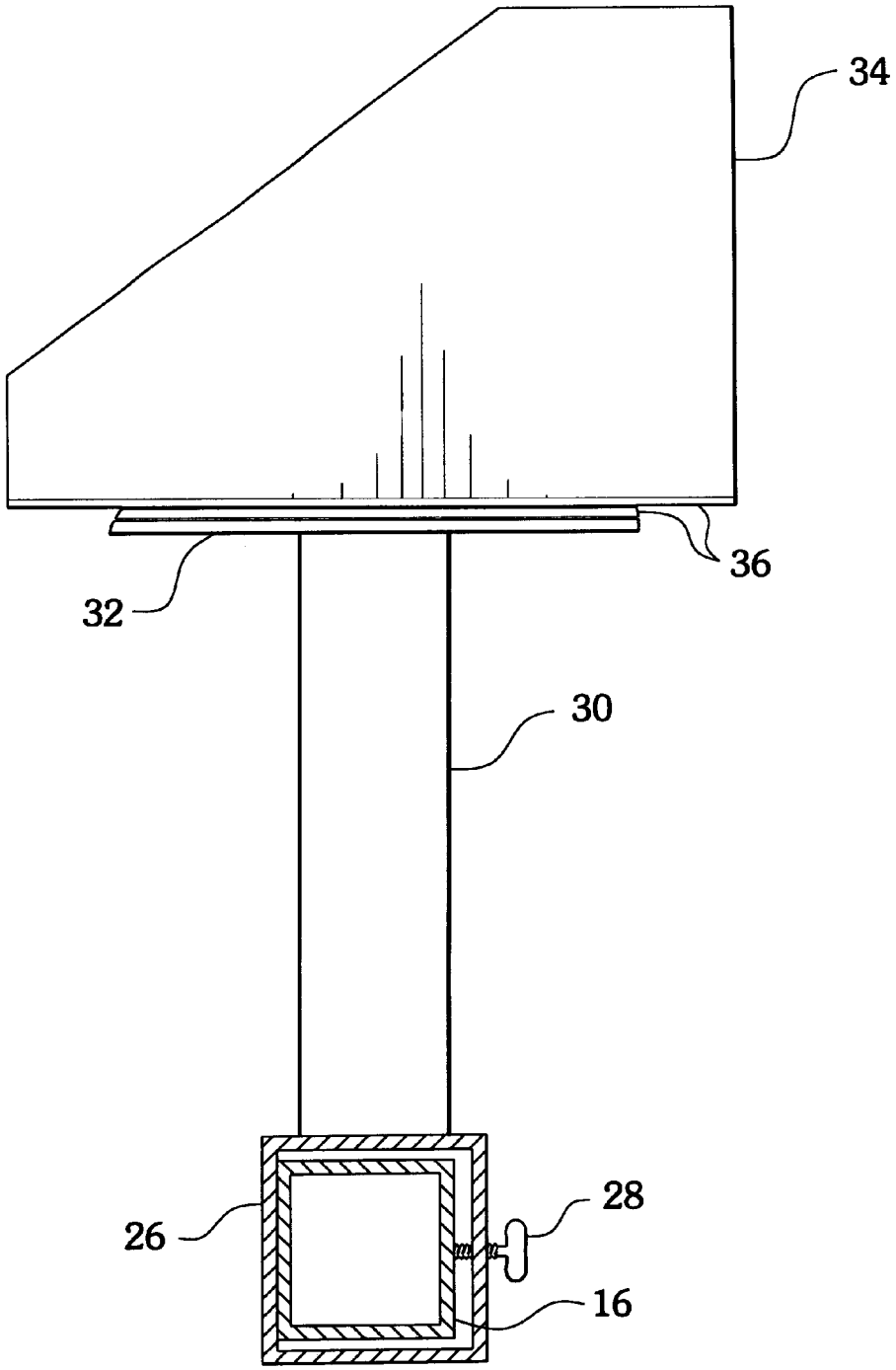
FIG. 3 is a section view along the line 3—3 of FIG. 2.
Figure 4:
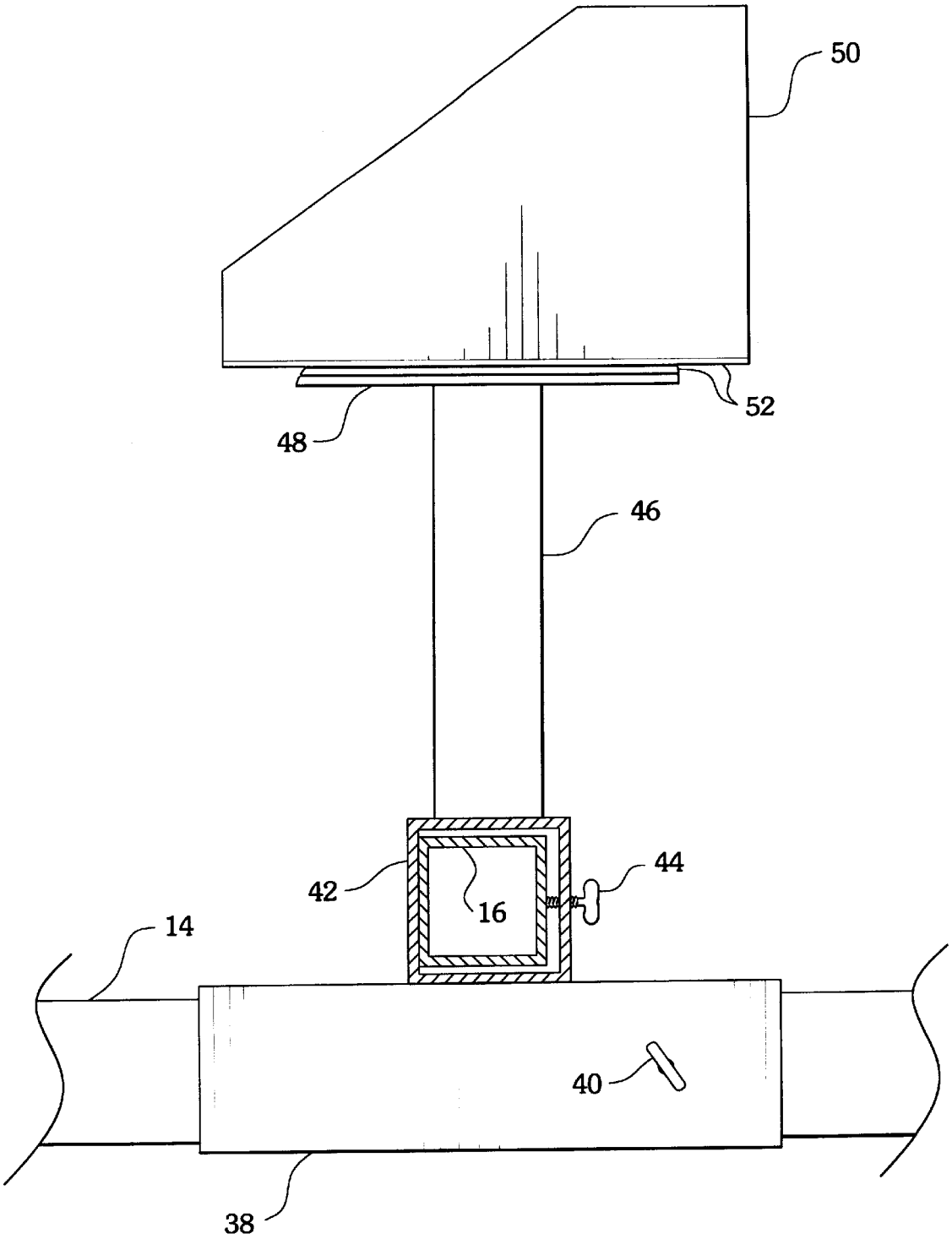
FIG. 4 is a section view along the line 4—4 of FIG. 2.

The frame 10 includes intermediate sleeves 26, as shown in FIGS. 2 and 3. The intermediate sleeves 26 are hollow and preferably square in cross section, having an inside perimeter slightly larger than the outside perimeter of longitudinal beams 16. The sleeves 26 are slidably mounted on the longitudinal beams 16 and temporarily secured by thumbscrews 28 which clamp the longitudinal beams 16 against the opposing walls of the sleeves 26. A vertical post 30 is fixedly mounted, as by welding, on the top wall of each sleeve 26 at a right angle to the sleeve 26. The vertical posts 30 preferably have the same size and construction as vertical posts 22. In the preferred embodiment, vertical posts 30 are made from stainless steel, are hollow and tubular, square in cross section, and measure 1"×1" and four inches long. Stainless steel pad mounting platforms 32 are mounted on the top of the vertical posts 30.

Antero-lateral chest pads 34 are mounted to the platforms 32, preferably by hook and loop fastening material 36 such as Velcro® fixedly attached to the platforms 32 and the bottom of the pads 34. Preferably in vertical cross section the antero-lateral chest pads 34 are shaped with a rectangular base lower section and a trapezoidal upper section, having a side which slopes inward and downward towards the open rectangular base defined by the lateral beams 12, 14 and longitudinal beams 16, as seen most clearly in FIG. 2, and may be made from any conventionally known surgical pad material. An exemplary material which could be used is a viscoelastic, polymeric material sold under the trade name Akton® Polymer by Action Products, Inc. of Hagerstown, Md., product number 40622, but custom sized, preferably to 6"L×6¼"W×5"H. The platforms 32 are preferably flat and rectangular, having a width approximately two inches shorter than the width of the pads 34, permitting a two inch range of lateral adjustment of the pads 34.

The frame 10 further includes a pair of transverse sleeves 38, which are hollow, tubular, and have an inside perimeter slightly larger than the outside perimeter of second lateral beam 14. The transverse sleeves 38 are slidably mounted on the second lateral beam 14 and temporarily secured by thumbscrews 40. Longitudinal sleeve 42 is fixedly mounted, as by welding, to the top surface of transverse sleeve 38 at right angles to transverse sleeve 38. Longitudinal sleeves 42 are slidably mounted on longitudinal beams 16 and temporarily secured by thumbscrews 44. It will be apparent to those skilled in the art that, although sleeves 18, 26, 38, and 42 are shown in the drawings being secured to the beams by thumbscrews, the sleeves 18, 26, 38, and 42 may be temporarily clamped or secured to the beams by a variety of conventional clamping or locking mechanisms well known in the art. Vertical posts 46, having the same construction and dimensions as vertical posts 30, are mounted on the top wall of longitudinal sleeves 42. Pad mounting platforms 48 are mounted on the top ends of posts 46.

Hip pads 50 are mounted to the platforms 48, preferably by hook and loop fastening material 52 such as Velcro® fixedly attached to the platforms 48 and the bottom of the pads 50. Preferably the size, shape and material of hip pads 50 are identical to that of antero-lateral chest pads 34.

Optionally, the frame 10 may include feet 54 positioned under the ends of the first 12 and second 14 lateral beams. The feet 54 should be from a material resistant to sliding or skidding on the surface of the table A, such as rubber or neoprene. The feet 54 may be removably attached to the beams 12, 14, as is conventionally known in the art. Advantageously, the feet 54 lift the frame 10 far enough above the table that an x-ray cassette may slide under the frame so that plain film x-rays may be taken intraoperatively.

It will be apparent from this construction that the longitudinal beams 16 are disposed in a horizontal plane vertically superior to the horizontal plane in which the lateral beams 12, 14 are disposed. It will also be apparent that the lateral and longitudinal separation of the pads may be adjusted by loosening the appropriate thumbscrews and sliding the sleeves, thereby adjusting the size of the frame 10 to the skeletal frame of the patient A.

In use, the frame 10 is assembled by sliding the first lateral beam 12 through sleeves 18 and tightening thumbscrews 20, sliding sleeves 26 onto longitudinal beams 16 and tightening thumbscrews 28, sliding sleeves 42 onto longitudinal beams 16 and tightening thumbscrews 44, and sliding second lateral beam 14 into sleeves 38 and tightening thumbscrews 40. The position of the pads 24, 34, and 50 are adjusted to the patient B with the frame 10 inverted and the patient in the supine position. The upper chest pads 24 should be positioned below the second rib and above the nipple line or the fifth rib at the sternoclavicular line, each pad 24 being disposed on opposite sides of the patient's B midline. The antero-lateral chest pads 34 should be positioned below the fourth rib, not to extend below the costal margin at the mid axillary line, each pad 34 being disposed on opposite sides of the patient's B midline. The hip pads 50 are placed on the anterior aspect of the ilioinguinal region, each pad 50 being disposed on opposite sides of the patient's B midline.

The frame 10 is placed on the table A and secured per facility policy. The patient B is then rotated, positioned on the frame 10, and secured. The patient's B head and upper arms are supported in accordance with instructions of the anesthesiologist. The patient's B knees are supported on knee pads, which may be elevated or lowered to further decrease or increase flexion of the hips, respectively, if desired for the particular surgery in hand. The frame 10 will generally support the patient B is a prone position with the hips flexed to less than 60°, a 30-30 flexion of the hips and knees being preferable. It will be noted that positioning the longitudinal beams 16 at a fixed distance outside the vertical posts 22 will ordinarily ensure that the longitudinal beams will not interfere with C-arm fluoroscopy or radiography of the spine. After use, the frame 10 may be conveniently collapsed and stored on a shelf. Advantageously, the frame 10 is small enough and light enough to be manipulated by one person.

It is to be understood that the present invention is not limited to the embodiments described above, but encompasses any and all embodiments within the scope of the following claims.

I claim:

1. A frame for prone surgical positioning adapted for use in positioning a patient in a prone position for surgery, comprising:

a) a first lateral beam;

b) a second lateral beam;

c) a pair of opposing longitudinal beams, said first and second lateral beams being connected to the longitudinal beams to define an open rectangular base disposed horizontally;

d) a pair of surgical upper chest pads, each of the pads being disposed on a vertical post fixedly attached to a sleeve slidably disposed about said first lateral beam;

e) a pair of surgical antero-lateral chest pads, each of the pads being disposed on a vertical post fixedly attached to a sleeve slidably disposed about one of said opposing longitudinal beams;

f) a pair of surgical hip pads, each of the pads being disposed on a vertical post fixedly attached to a longitudinal sleeve slidably disposed about one of said opposing longitudinal beams, the longitudinal sleeve being fixedly attached to a transverse sleeve, said second lateral beam being slidably disposed in said transverse sleeves;

g) a plurality of flat, rectangular platforms, the platforms being mounted on top of the vertical posts supporting said chest pads, the vertical posts supporting said antero-lateral chest pads, and the vertical posts supporting said hip pads; and h) a piece of hook and loop fastening material fixedly attached to the top of each of said platforms, and a mating piece of hook and loop fastening material fixedly attached to said upper chest pads, said antero-lateral chest pads and said hip pads, whereby said pads are removably attached to said platforms, said frame being adapted for placement on a surgical operating table, a patient being positioned on said frame in a prone position for surgery.

2. The frame for prone surgical positioning according to claim 1, wherein the sleeves supporting said upper chest pads, the sleeves supporting said antero-lateral chest pads, said longitudinal sleeves and said lateral sleeves each further comprise means for temporarily securing the position of said sleeves on said frame.

3. The frame for prone surgical positioning according to claim 1, wherein said lateral beams, said longitudinal beams, and said vertical posts are made from wood.

4. The frame for prone surgical positioning according to claim 1, wherein said lateral beams, said longitudinal beams, and said vertical posts are hollow, tubular, and made from stainless steel.

5. The frame for prone surgical positioning according to claim 1, wherein said lateral beams, said longitudinal beams, and said vertical posts are hollow, tubular, and made from aluminum.

6. The frame for prone surgical positioning according to claim 1, wherein each of said longitudinal beams has a first end and a second end, the first end of each said longitudinal beams being fixedly attached to a sleeve supporting one of said upper chest pads a fixed distance from the vertical post towards the outside of said frame, so that one of the longitudinal beams attached to a sleeve supporting one of said upper chest pads is a mirror image of the other longitudinal beam attached to a sleeve supporting the other upper chest pad.

7. The frame for prone surgical positioning according to claim 1, wherein each of said upper chest pads, said antero-lateral chest pads, and said hip pads are about two inches wider than said platform upon which said pad is mounted.

8. The frame for prone surgical positioning according to claim 1, wherein said upper chest pads, said antero-lateral chest pads and said hip pads are made from a viscoelastic polymer.

9. The frame for prone surgical positioning according to claim 1, further comprising a plurality of feet, said feet being mounted on said first and second lateral beams.

10. The frame for prone surgical positioning according to claim 9, wherein said feet are made from rubber.

11. A frame for prone surgical positioning adapted for use in positioning a patient in a prone position for surgery, comprising:

a) a first lateral beam;

b) a second lateral beam;

c) a pair of opposing longitudinal beams, said first and second lateral beams being connected to the longitudinal beams to define an open rectangular base disposed horizontally;

d) a pair of surgical upper chest pads, each of the pads being disposed on a vertical post fixedly attached to a sleeve slidably disposed about said first lateral beam, wherein said upper chest pads have the shape of a right prism, a cross section of each upper chest pad taken through a vertical plane being rectangular, e) a pair of surgical antero-lateral chest pads, each of the pads being disposed on a vertical post fixedly attached to a sleeve slidably disposed about one of said opposing longitudinal beams;

f) a pair of surgical hip pads, each of the pads being disposed on a vertical post fixedly attached to a longitudinal sleeve slidably disposed about one of said opposing longitudinal beams, the longitudinal sleeve being fixedly attached to a transverse sleeve, said second lateral beam being slidably disposed in said transverse sleeves, said frame being adapted for placement on a surgical operating table, a patient being positioned on said frame in a prone position for surgery; and g) a plurality of flat, rectangular platforms, the platforms being mounted on top of the vertical posts supporting said chest pads, the vertical posts supporting said antero-lateral chest pads, and the vertical posts supporting said hip pads, said frame being adapted for placement on a surgical operating table, a patient being positioned on said frame in a prone position for surgery.

12. A frame for prone surgical positioning adapted for use in positioning a patient in a prone position for surgery, comprising;

a) a first lateral beam;

b) a second lateral beam;

c) a pair of opposing longitudinal beams, said first and second lateral beams being connected to the longitudinal beams to define an open rectangular base disposed horizontally;

d) a pair of surgical upper chest pads, each of the pads being disposed on a vertical post fixedly attached to a sleeve slidably disposed about said first lateral beam;

e) a pair of surgical antero-lateral chest pads, each of the pads being disposed on a vertical post fixedly attached to a sleeve slidably disposed about one of said opposing longitudinal beams;

f) a pair of surgical hip pads, each of the pads being disposed on a vertical post fixedly attached to a longitudinal sleeve slidably disposed about one of said opposing longitudinal beams, the longitudinal sleeve being fixedly attached to a transverse sleeve, said second lateral beam being slidably disposed in said transverse sleeves, said frame being adapted for placement on a surgical operating table, a patient being positioned on said frame in a prone position for surgery, wherein said antero-lateral chest pads and said hip pads have the shape of a right prism, a cross section taken though a vertical plane having a rectangular lower section and a trapezoidal upper section, having a side which slopes inward and downward towards the open rectangular base defined by said lateral beams and said longitudinal beams; and g) a plurality of flat, rectangular platforms, the platforms being mounted on top of the vertical posts supporting said chest pads, the vertical posts supporting said antero-lateral chest pads, and the vertical posts supporting said hip pads, said frame being adapted for placement on a surgical operating table, a patient being positioned on said frame in a prone position for surgery.

* * * * *